United States Patent [19]

Ishii

[11] Patent Number: 4,627,607

[45] Date of Patent: Dec. 9, 1986

[54] SHEET FEEDING SYSTEM

[75] Inventor: Yasuaki Ishii, Ichikawa, Japan

[73] Assignee: Ricoh Company, Ltd., Japan

[21] Appl. No.: 541,376

[22] Filed: Oct. 13, 1983

[30] Foreign Application Priority Data

| | | | |
|---|---|---|---|
| Oct. 15, 1982 | [JP] | Japan | 57-155225[U] |
| Oct. 15, 1982 | [JP] | Japan | 57-179782 |
| Oct. 16, 1982 | [JP] | Japan | 57-180559 |
| Feb. 10, 1983 | [JP] | Japan | 58-17444[U] |

[51] Int. Cl.[4] ..... B65H 3/06

[52] U.S. Cl. ..... 271/122; 271/274; 271/9

[58] Field of Search ..... 271/4, 10, 21, 114, 271/117, 118, 122, 124, 125, 272, 273, 274, 9

[56] References Cited

U.S. PATENT DOCUMENTS

| | | | |
|---|---|---|---|
| 408,405 | 8/1889 | Dolphin | 271/122 |
| 1,590,611 | 6/1926 | Wright et al. | 271/118 |
| 2,036,919 | 4/1936 | Calmes | 271/125 |
| 3,556,512 | 1/1971 | Fackler | 271/122 |
| 3,754,754 | 8/1973 | Peterson | 271/122 |
| 3,936,042 | 2/1976 | Smith et al. | 271/125 |
| 4,025,187 | 5/1977 | Taylor et al. | 271/10 |
| 4,368,881 | 1/1983 | Landa | 271/125 |
| 4,461,212 | 7/1984 | Geney | 271/274 |
| 4,482,148 | 11/1984 | Stewart | 271/273 |

FOREIGN PATENT DOCUMENTS

| | | | |
|---|---|---|---|
| 0199744 | 12/1982 | Japan | 271/125 |

*Primary Examiner*—Bruce H. Stoner, Jr.
*Assistant Examiner*—James E. Barlow
*Attorney, Agent, or Firm*—Guy W. Shoup

[57] ABSTRACT

A sheet feeding system of a frictional sheet separation type including a feed roller rotating in a sheet feeding direction, and a separation roller maintained in pressing contact with the feed roller with a path of travel of a sheet therebetween and having applied to it a predetermined torque oriented in a direction opposite the sheet feeding direction. The system further includes a separation roller shaft supporting the separation roller at one end thereof and pivotable at the other end thereof for pivotal movement in a plane including its own axis and the axis of the feed roller, a pivot for biasing the separation roller shaft toward the feed roller, and a slide for guiding the separation roller shaft in such a manner that it rotates in a plane including its own axis and the axis of the feed roller.

9 Claims, 18 Drawing Figures

SHEET FEEDING SYSTEM

FIELD OF THE INVENTION

This invention relates to a sheet feeding system suitable for use with a copying apparatus, facsimile system, etc., capable of feeding sheets, such as transfer-printing sheet, to a printing station from a stack of sheets piled one over another by separating each sheet from other sheets so that each sheet is fed orderly in a controlled manner.

DESCRIPTION OF THE PRIOR ART

One type of sheet feeding system for a copying apparatus and the like is a sheet feeding system of the frictional sheet separation type comprising a feed roller rotating in a sheet feeding direction, and a separation roller maintained in pressing engagement with the feed roller with a path of travel of sheets interposed therebetween and having applied thereto a predetermined torque oriented in a direction opposite the direction in which the sheets are fed, wherein when no sheet is held between the two rollers or when one sheet is being fed to the two rollers, the frictional force acting between the rollers or between the sheet and the rollers overcomes the torque to let the separation roller roll by following the feed roller to allow a sheet to be fed to the rollers or enable the sheet being fed to the rollers to be fed to the printing station and when more than two sheets are fed to a nip between the rollers, the torque applied to the separation roller overcomes the frictional force acting between the sheets to return the second and the following sheets toward the sheet feed tray to separate them from the first sheet in direct contact with the feed roller, so that only the first sheet can be fed to the printing station.

This type of sheet feeding system is superior to a sheet feeding system of the type in which the separation roller is rotating in a direction opposite the sheet feeding direction or remains stationary at all times in that no slip occurs between the separation roller and the feed roller or the sheet, that the trouble of the sheet becoming coarse or minuscule particles of paper dust being produced due to wear caused on the sheet is reduced and that no reduction occurs in the coefficient of friction of the rollers due to the aforesaid trouble.

In this type of sheet feeding system, a separation roller 2 is supported at one end of a lever 4 pivotably supported by a pin 7 as shown in FIG. 1, and forced against a feed roller 1 by the biasing force of a spring 5 mounted between the other end of the lever 4 and a machine frame. A gear 6 coaxial with the separation roller 2 is driven by a drive gear 8 mounted on the pin 7 supporting the lever 4. A torque limiter is also mounted on the pin 7.

In this construction, the relation between the sheet returning force $T_A$ exerted by the separation roller 2 and the pressing force $P_B$ with which the separation roller 2 presses against the feed roller 1 is determined, in view of the moment of balance about the pin 7 for supporting the lever 4, by Y/X where X is the distance between the pin 7 and a line normal to the point of pressure contact between the two rollers 1 and 2, and Y is the distance between the pin 7 and a tangent to the point of pressure contact between the two rollers 1 and 2. However, since the sheet feeding system shown in FIG. 1 relies for sheet separation and sheet feeding on the forces of friction acting between the rollers 1 and 2 and a sheet 3, wear would be caused on the rollers 1 and 2 with time and their outer diameters would show a decrease gradually. Assume that the outer diameters of the two rollers 1 and 2 are reduced as indicated by phantom lines in FIG. 1. Then, although the center position of the feed roller 1 would remain unchanged, the center position of the separation roller 2 which is pressed against the feed roller 1 at all times would move along a circular arc centered at the pin 7 because the lever 4 pivotally moves in a counterclockwise direction about the pin 7, with a result that the X would be decreased to X′ while the Y would be increased to Y′. Thus the ratio Y/X would increase.

Thus, the sheet feeding system of the aforesaid construction would suffer the disadvantage that the sheet returning force $T_A$ exerted by the separation roller 2 relative to the pressing force $P_B$ with which the separation roller 2 presses against the feed roller 1 which remains constant would be gradually reduced, so that the separation capacity of the system would be reduced and its reliability would be lowered.

SUMMARY OF THE INVENTION

This invention has been developed for the purpose of obviating the aforesaid disadvantage of the sheet feeding system of the frictional sheet separation type of the prior art constructed as aforesaid in which a predetermined torque is given to the separation roller in a sheet returning direction. Accordingly, the invention has as its object the provision of a sheet feeding system of a frictional sheet separation type of high reliability in performance in which the sheet returning force exerted by the separation roller relative to the pressing force with which the separation roller presses against the feed roller shows almost no change with time.

To accomplish the aforesaid object, the invention provides a feature that the separation roller is able to move toward the axis of the feed roller. By virtue of this feature, even if wear might be caused on the two rollers, no displacement would be produced in the direction normal to the plane of the axes of the two rollers, although the axes might slightly move toward each other. This enables the relation between $T_A$ and $P_B$ to be kept substantially constant at all times, so that the system is able to perform sheet separation in a stable manner.

DESCRIPTION OF THE PREFERRED EMBODIMENTS

The invention will now be described in detail by referring to a preferred embodiment shown in the accompanying drawings.

Figure 2:
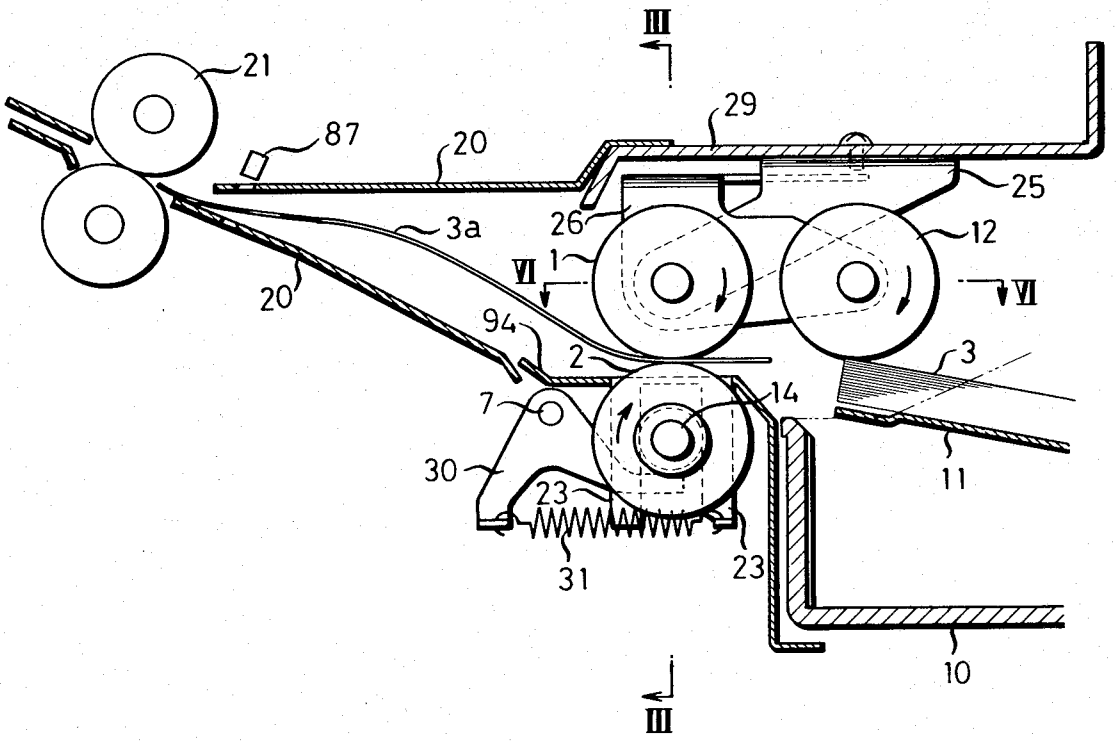
FIG. 2 is a sectional side view of the sheet feeding system comprising one embodiment of the invention.
Figure 3:
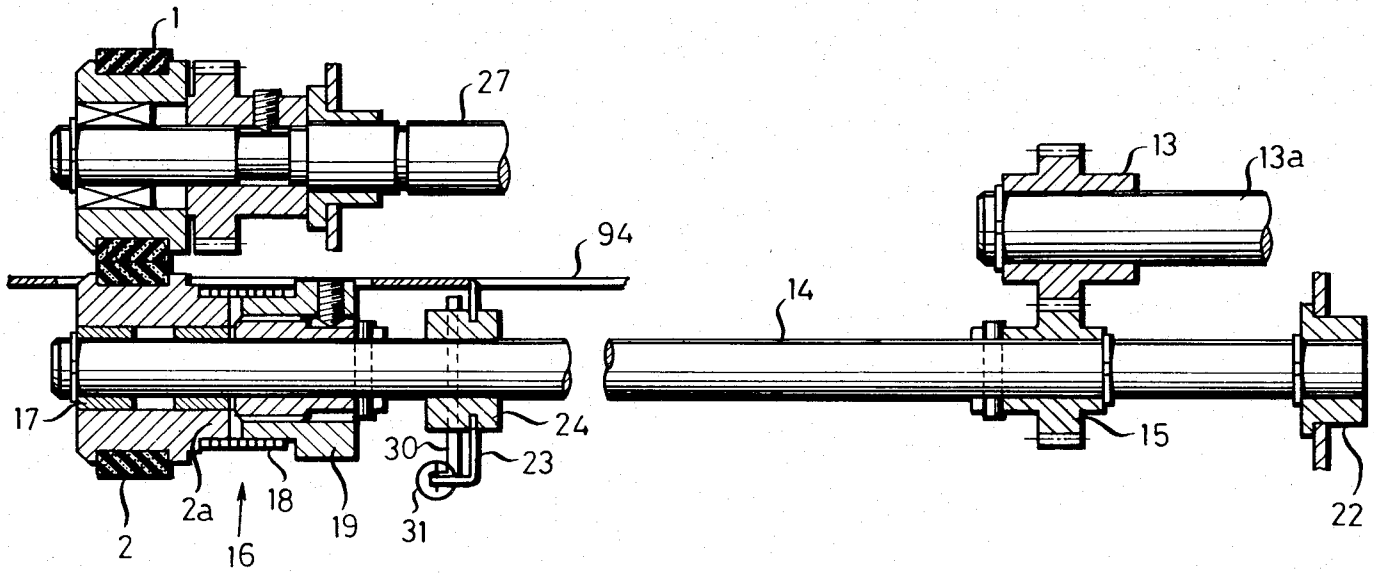
FIG. 3 is a sectional view taken along the line III—III in FIG. 3.

FIG. 2 is a sectional view of an embodiment incorporated in a transfer printing sheet feeding system of an electrophotographic copying apparatus, and FIG. 3 is a sectional view of portions of the transfer printing sheet feeding system shown in FIG. 2, showing a feed roller 1, a separation roller 2, shafts supporting the rollers 1 and 2 and parts associated therewith as viewed in a direction perpendicular to the shafts.

Referring to FIG. 2, transfer printing sheets 3 are stacked on a bottom plate 11 of a cassette 10 and raised to a predetermined level by elevating means, not shown. A pickup roller 12 is brought into pressing engagement with a top surface of the stack of sheets 2 with a predetermined timing as a sheet feeding signal is produced and rotates in a sheet feeding direction to feed by friction an uppermost sheet to a nip between the pair of feed roller 1 and the separation roller 2 located downstream of the pickup roller 12. The feed roller 1 is rotated by a clutch, not shown, during a predetermined period of time in the sheet feeding direction indicated by an arrow. The separation roller 2 has applied thereto through a drive gear 13 driven for rotation by a drive source, not shown, a gear 15 secured to a separation roller shaft 14 and a torque limiter 16 mounted on the shaft 14 a predetermined torque oriented in a sheet returning direction indicated by an arrow in FIG. 2. The separation roller 2 is brought into pressing engagement with the feed roller 1, as subsequently to be described, by a pressure applying spring 31 through a pressure applying arm 30 with a predetermined pressing force.

As described hereinabove, the torque applied to the separation roller 2 by the torque limiter has a value such that when no sheet is held between the two rollers 1 and 2 or one sheet is being fed to a nip between them, the separation roller 2 rotates following the rotation of the feed roller 1 and that when more than two sheets are fed to the nip between them, the torque overcomes the frictional force acting between the sheets and allows the separation roller 2 to rotate in the sheet returning direction.

Thus, the sheets are separated by the separation roller 2 and only one sheet is fed by the feed roller 1, so that it moves into a space between sheet guides 20 and has a predetermined loosening given thereto by a pair of register rollers 21 to thereby remove a skew therefrom, before being fed into a printing station along an outer peripheral surface of a photosensitive drum.

Referring to FIG. 3, the separation roller 2 is rotatably supported by the shaft 14 through a bearing 17 and has a left half portion of a torque limiter spring 18 attached to a right half portion 2a with a biasing force high enough to produce a frictional force necessary to apply the predetermined torque to the roller 2. The torque limiter spring 18 has its right half portion attached in a compressed state to a separation hub 19 secured to the separation roller shaft 14, to constitute the torque limiter 16. The separation roller shaft 14 is journalled at its right end by a bearing 22 in such a manner that it is capable of tilting in a certain range in a plane including the shaft 14 and a feed roller shaft (or a plane including the surface of FIG. 3) and capable of rotating about its own axis. Moreover, the separation roller shaft 14 is journalled by a slide bearing 24 fitted between shaft guides 23 for guiding the separation roller shaft 14 for sliding movement in a plane including the axis of the feed roller 1 and the axis of the separation roller 2, said shaft guides 23 are secured to a machine frame on the right side of the torque limiter 16 as shown in FIG. 3. The slide bearing 24 has its bottom surface slidably pressed by a top surface of one end of the pressure applying arm 30 urged by the biasing force of the pressure applying spring 31 to move in pivotal movement about a pin 7. Thus the separation roller 2 is forced against the feed roller 1 with a predetermined pressing force.

Figure 4:
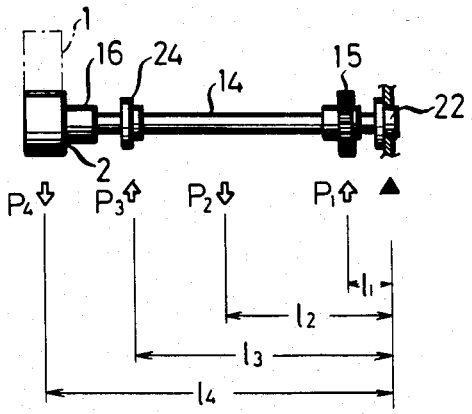
FIG. 4 is a schematic view in explanantion of the relation between the pressing force $P_B$ and the sheet returning force $T_A$ exerted by the separation roller 2 of the sheet feeding system shown in FIG. 3.

In this embodiment shown and described hereinabove, the separation roller section is constructed as aforesaid, so that the sheet returning force $T_A$ exerted by the separation roller 2 and the pressing force $P_B$ with which the separation roller 2 presses against the feed roller 1 are related to each other as follows:

As shown schematically in FIG. 4, the following relation holds in view of the moment balance about the bearing (pivot) 22:

$$l_1P_1+l_3P_3=l_2P_2+l_4P_4$$

$$\therefore P_4=\frac{l_1}{l_4}P_1+\frac{l_3P_3-l_2P_2}{4} \quad (1)$$

where $P_1$: pressing force exerted by the drive gear 13 on the tooth surface of the separation gear 15;

$P_2$: weight of the separation shaft 14 and the parts secured thereto;

$P_3$: force applied by the pressure applying arm 30 to lift the slide bearing 24;

$P_4$: Pressing force acting between the feed roller 1 and separation roller 2;

$l_1$: distance between the bearing (pivot) 22 and the point on which $P_1$ acts;

$l_2$: distance between the bearing (pivot) 22 and the point on which $P_2$ acts;

$l_3$: distance between the bearing (pivot) 22 and the point on which $P_3$ acts;

$l_4$: distance between the bearing (pivot) 22 and the point in which $P_4$ acts.

Also, the pressing force $P_1$ exerted on the separation gear 15 is related to the sheet returning force $T_A$ as follows:

$$P_1 = 1.5T_A \quad (2)$$

where 1.5 is the ratio of the radius of the separation gear 15 to that of the separation roller 2.

Also, the pressing force $P_4$ is related to the pressing force $P_B$ as follows:

$$P_B = P_4 \quad (3)$$

By substituting equations (2) and (3) into equation (1), the following relation is obtained:

$$P_B = 1.5 \times \frac{l_1}{l_4} T_A + \frac{l_3P_3 - l_2P_2}{l_4}$$

Figure 1:
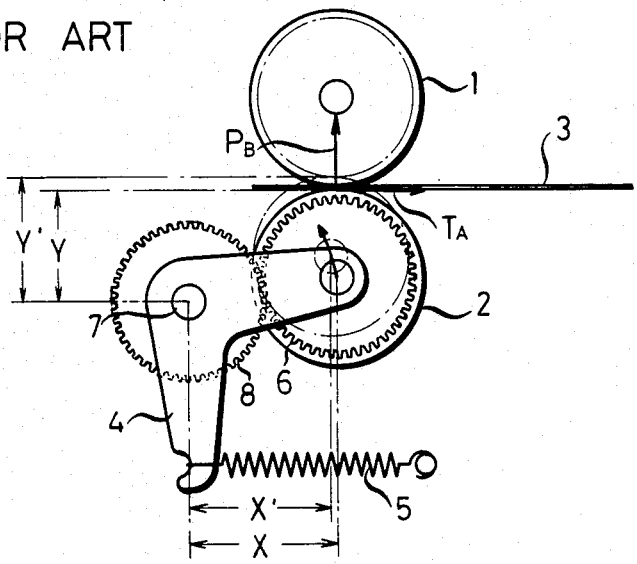
FIG. 1 PRIOR ART
FIG. 1 is a side view of a sheet feeding system of the prior art, showing its essential portions.

It will be seen that the relation between $T_A$ and $P_B$ is decided by the relation between the distance between the pivot 22 and gear 15, the distance between the pivot 22 and the bearing 24 and between the pivot 22 and the separation roller 2. Once decided, these positions show no change with time. Wear caused on the separation roller 2 might cause a slight change to occur in the ratio 1.5 of the radius of the separation gear 15 to that of the separation roller 2. In the sheet feeding system of the construction according to the invention, when wear is caused on the separation roller 2 and feed roller 1, the bearing 24 of the separation roller 2 is guided by the guides 23 while slipping with respect to a top surface of the pressure applying arm 30, so that the value of X shown in FIG. 1 shows no change.

Thus, substantially no influences are exerted on the relation between $T_A$ and $P_B$ by wear caused on the rollers and a value at which the relation set initially can be maintained over a prolonged period of time. The relation between $T_A$ and $P_B$ may, for example, be advantageously set as follows:

$$P_B = 0.16T_A + 400(gf)$$

Figure 5:
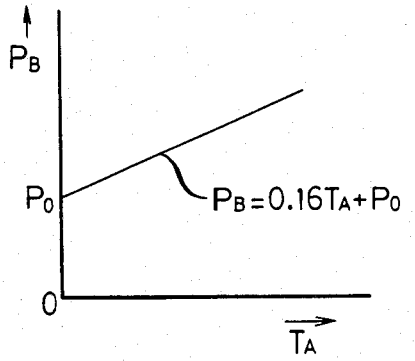
FIG. 5 is a diagrammatic representation of the relation between $T_A$ and $P_B$ obtained in the sheet feeding system shown in FIG. 3.

In FIG. 5, the abscissa represents $T_A$ and the ordinate indicates $P_B$ and a $T_A$-$P_B$ curve of the aforesaid formula is shown. In the diagram, shown therein, $\overline{OP}o = 400$ and the tilting of the straight line corresponds to 0.16.

Thus, by constructing the support mechanism for the separation roller 2 as described hereinabove, it is possible to readily set the values of the tilting of the straight line indicating the relation between $T_A$ and $P_B$ and the height of the point representing $T_A = 0$ at any arbitrarily selected levels.

In the sheet feeding system of the prior art shown in FIG. 1, the torque limiter is supported on the pin 7, not on the shaft of the separation roller 2. In the embodiment of the invention shown and described hereinabove, the torque limiter 16 is secured to the separation roller shaft 14 as a unit with the separation roller 2, so that the torque set is transmitted as it is to the separation roller 2 and a loss of torque can be minimized.

Figure 6:
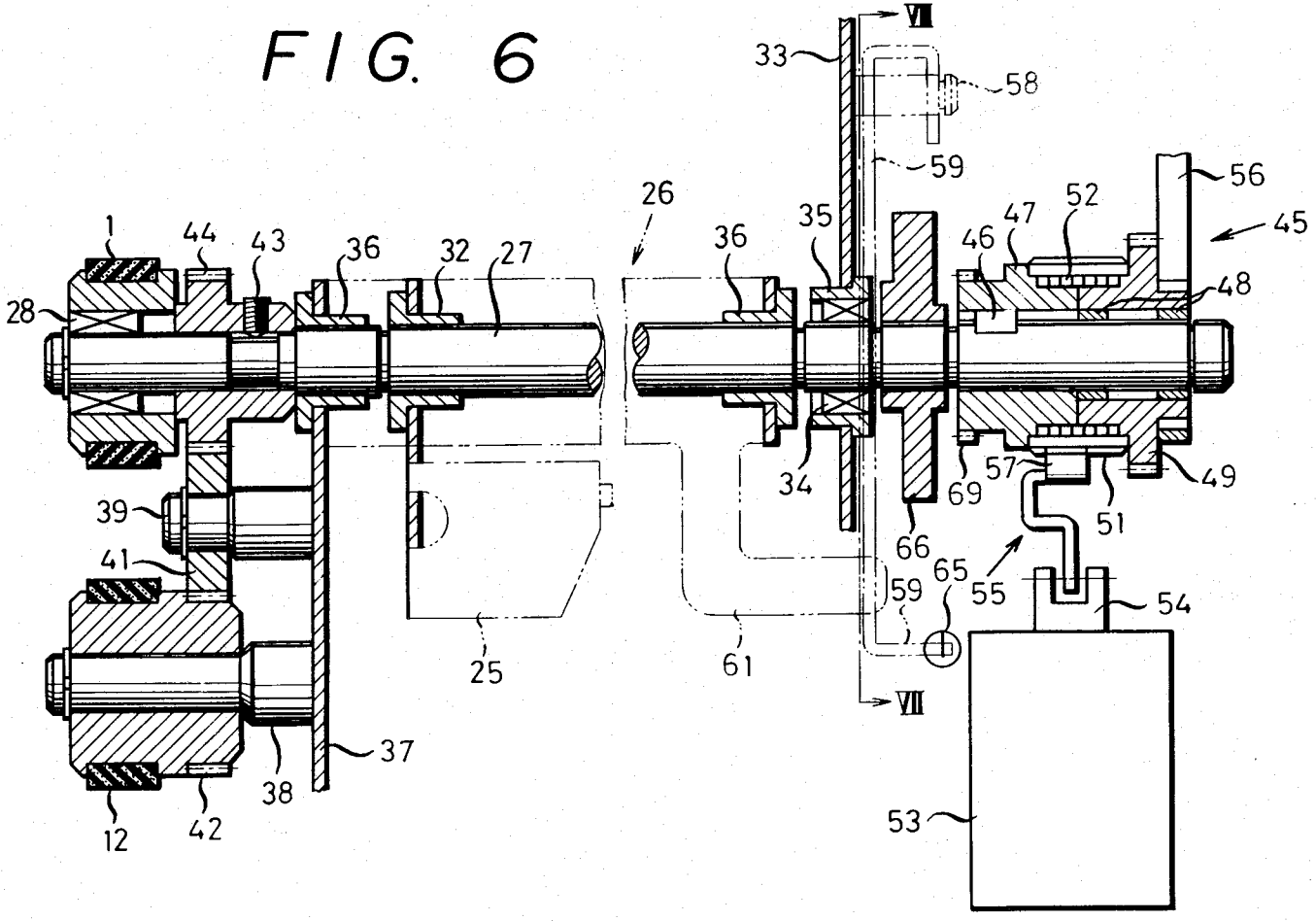
FIG. 6 is a sectional view taken along the line VI—VI in FIG. 2.

A mechanism for rotating the feed roller 1 may be constructed as follows. In FIG. 6 which is a sectional view taken along the line VI—VI in FIG. 1, a bracket 25 and an arm member 26 indicated by phantom lines are similar to a bracket and an arm member designated by like reference characters in FIG. 2. The feed roller 1 is mounted through a one-way clutch 28 on a left end portion of a feed roller shaft 27 which is journalled by a bearing 32 at a forward end of the bracket 25 secured to a stay 29 (see FIG. 2) and also by a bearing 35 attached to a side plate 33 secured to the machine frame and having a built-in one-way clutch 34. The feed roller shaft 27 supported in this way has pivotally connected thereto through two bearings 36 the arm member 26 including an arm 37 located on the left side in the figure which has two pins or a long pin 38 and a short pin 39 secured thereto. The long pin 38 supports the pickup roller 12 for rotation and the short pin 39 supports and idle gear 41 for rotation which is in meshing engagement with a gear 42 connected to a base of the pickup roller 12 to provide a unitary structure and a gear 44 secured to the feed roller shaft 27 by a set screw 43. By this arrangement, rotation of the feed roller 1 causes the pickup roller 12 to rotate in the same direction.

To drive the feed roller 1 for rotation, a spring clutch generally designated by the reference numeral 45 is attached to the outer side (right side in FIG. 6) of a side plate 33. The spring clutch 45 comprises a follower hub 47 secured to the feed roller shaft 27 by a key 46, a drive hub 49 rotatably mounted on the feed roller shaft 27 through a bearing 48, a spring 52 mounted between the drive hub 49 and follower hub 47 and secured at one end to the follower hub 47 and at the other end to a sleeve 51, and an actuating lever 55 connected to a plunger 54 of a solenoid 53. The drive hub 49 is rotated through a timing belt 56 by a drive source, not shown. Rotation of the drive hub 49 is transmitted, when a pawl 57 of the actuating lever 55 is out of engagement with the sleeve 51, to the follower hub 47 while the drive hub 49 is clamped against the follower hub 47 by the biasing force of the spring 52, to rotate the follower hub 47 and hence the feed roller shaft 27. When the pawl 57 is brought into engagement with the sleeve 51, the drive hub 49 is released from clamping engagement with the follower hub 47, so that the follower hub 47 does not rotate and the feed roller shaft 27 does not rotate. By effecting on-off control of the solenoid 53, it is possible to cause the feed roller 1 to rotate with a good timing.

As described hereinabove, rotation of the pickup roller 12 picks up the uppermost sheet of the stock of sheets 3 in the sheet feeding cassette 10 and moves same to the feedroller 1 (see FIG. 2). If the pickup roller 12 exerts a force on the sheet after it has reached the feed roller 1, it would be impossible to have the feed roller 1 feed the sheet to the printing station in good condition. In the embodiment shown and described hereinabove, the pickup roller 12 is moved back to a retired position in which it is not brought into contact with the sheet after the sheet has been moved a predetermined distance toward the feed roller 1.

Figure 7:
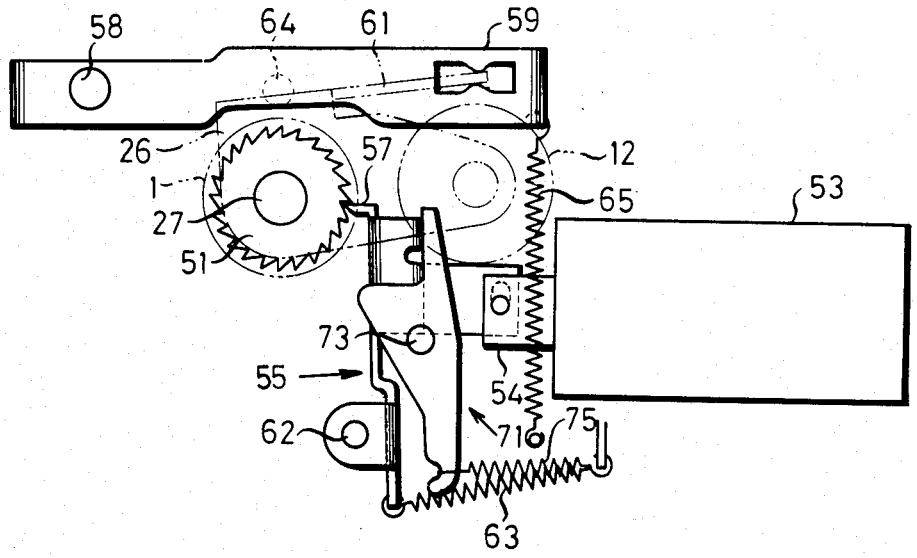
FIG. 7 is a schematic view in explanation of the sheet feeding system as viewed in the direction of lines VII—VII in FIG. 6.

More specifically, a pin 58 projecting rightwardly from the side plate 33 in FIG. 6 supports for pivotal movement a control lever 59 extending across the feed roller shaft 27 as indicated by phantom lines. As shown in FIG. 7, the control lever 59 is in engagement at an end portion thereof opposite the pin 58 with a forward end of a lever engaging arm 61 of the arm member 26. Thus, as the lever 59 moves in pivotal movement about the pin 58, the arm member 26 moves in pivotal movement about the feed roller shaft 27. Pivotal movement of the arm member 26 moves the pickup roller 12 held at a forward end portion of the arm 37 upwardly and downwardly. If the pickup roller is made to come into contact with the uppermost sheet of the stack of sheets 3 when it moves to a lower position, then it is possible to place the pickup roller 12 in the retired position referred to hereinabove in which it it not brought into contact with the picked up and moved sheet when the pickup roller moves to an upper position. By this arrangement, movement of the pickup roller to the retired position can be occasioned by the pivotal movement of the control lever 59.

In FIG. 7, the actuating lever 55 connected to the plunger 54 of the solenoid 53 can move in pivotal movement about a support pin 62 and has a tension spring 63 connected to its lower end, so that the lever 55 is normally biased in a counterclockwise direction and the pawl 57 of the lever 55 is in engagement with the sleeve 51.

Figure 8:
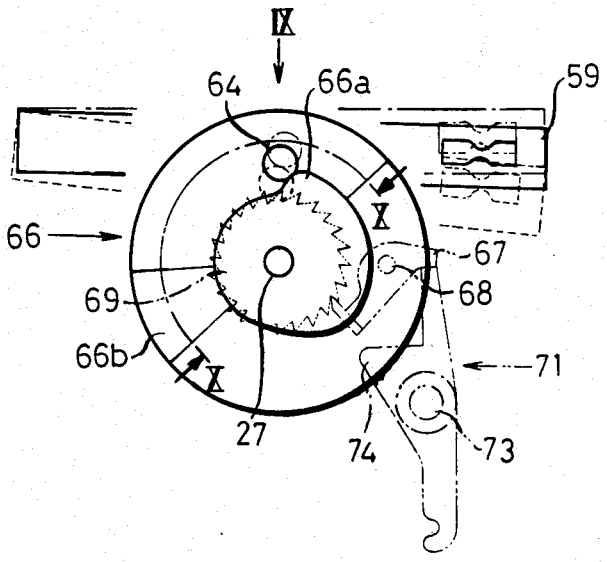
FIG. 8 is a schematic view in explanation of the relation between the control lever and the cam.
Figure 9:
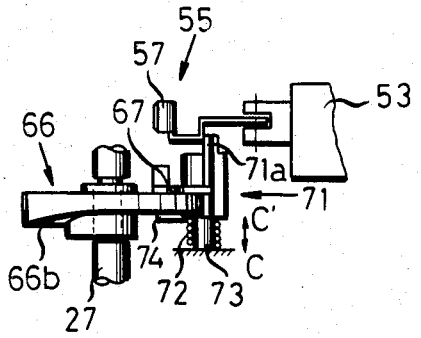
FIG. 9 is a schematic view of the cam and other parts as viewed in the direction of an arrow IX in FIG. 8.
Figure 10:
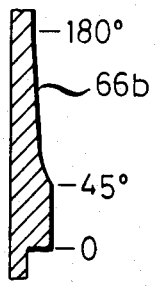
FIG. 10 is a sectional view taken along the lines X—X in FIG. 8, showing the slide control section of the cam.

As described hereinabove, the retiring movement of the pickup roller 12 is occasioned by the pivotal movement of the control lever 59. To this end, the control lever 59 has connected substantially to its central portion a cam follower 64 which is positioned against a cam 66 under the action of a pickup spring 65 as shown in FIG. 6 or 8. As shown in FIG. 8 the cam 66 has a height control section 66*a* and a slide control section 66*b*, and the cam follower 64 is positioned against the height control section 66*a*. A pin 68 attached to the back of the cam 66 has a pawl 67 pivotally connected thereto which is biased by a spring, not shown, to pivotally move toward a ratchet wheel 69. As shown in FIG. 6, the ratchet wheel 69 is formed at one end of the follower hub 47 of the spring clutch 45. The pawl 67 is normally in locking engagement with a forward end of a stopper 71 and remains stationary and held in a position in which it is spaced apart from the ratchet wheel 69. When the pawl 67 is in this position, the control lever 59 is in a stand-by position shown in solid lines and the pickup roller 12 is away from the uppermost sheet of the stack of sheets 3 by about 1–2 mm. The stopper 71 is forced by the biasing force of a slide spring 72 to move in the direction of the actuating lever 55 on a support pin 73, as shown in FIG. 9, so that a slide contacting section 74 of the stopper 71 is positioned against the slide control section 66*b* of the cam 66. When the stopper 71 is in this position, a projection 71*a* of the stopper 71 is in engagement with the actuating lever 55. When viewed along the line X—X in FIG. 8, the slide control section 66*b* of the cam 66 is configured as shown in FIG. 10, so that as the cam 66 rotates, the stopper 71 moves in C–C′ directions as shown in FIG. 9 on the support pin 73 by following the cross-sectional configuration of the slide control section 66*b*. The stopper 71 has connected to its lower end a tension spring 75 as shown in FIG. 7 which biases the stopper 71 to move in a counterclockwise direction about the support pin 73.

Assume that a sheet feeding command is given by a control unit, not shown, to energize the solenoid 53. The actuating lever 55 is pulled rightwardly in FIG. 7 and moves in pivotal movement in a clockwise direction, to cause the stopper 71 engaging the actuating lever 55 at the projection 71*a* (see FIG. 9) to move in pivotal movement in the same direction. As the stopper 71 moves in pivotal movement, the pawl 67 is released from locking engagement with the stopper 71 in FIG. 8 and moves in pivotal movement in a clockwise direction into engagement with the ratchet wheel 69. As described hereinabove, energization of the solenoid 53 causes the follower hub 47 of the spring clutch 45 to rotate in FIG. 6. In this case, the ratchet wheel 69 also rotates. Consequently, the cam 66 connected to the ratchet wheel 69 through the pawl 67 rotates in a clockwise direction in FIG. 8. At this time, the cam follower 64 moves in sliding movement on the height control section 66*a* of the cam 66 and then downwardly to keep the control lever 59 in a lower position shown in a brocken line for a predetermined period of time. When the control lever 59 is in the lower position, the pickup roller 12 is positioned against the uppermost sheet of the stack of sheets 3. The cam follower 64 which remains in a lower position for the predetermined period of time moves the control lever 59 upwardly to an upper position shown in phantom lines and assumes a position in which it presses against an inclined surface portion of the cam again.

In the meantime, rotation of the slide control section 66*b* of the cam 66 causes the stopper 71 to move in the direction of C in FIG. 9 on the support pin 73 and pivotally move, after being released from engagement with the actuating lever 55 with which it is in engagement, under the action of a tension spring 75 (FIG. 7) in a counterclockwise direction to a position in which it is positioned against a side of the cam 66. As the stopper 71 is restored to the original position as aforesaid, the pawl 67 moving along with the cam 66 is brought into engagement again with the forward end of the stopper 71 restored to the original position. The cam 66 stops rotating to move the control lever 59 and hence the pickup roller 12 to the standby position. Thereafter, the solenoid 53 is de-energized, thereby terminating the sheet feeding cycle.

As described in detail hereinabove, the pickup roller 12 is brought into contact with the uppermost sheet of the stack of sheets in the sheet feeding cassette for a predetermined period of time by the action of the cam 66 in this embodiment, to allow the pickup roller 12 to pick up the uppermost sheet and move same toward the feed roller. Thus the distance covered by the movement of the sheet as it is moved by the pickup roller is constant at all times regardless of the amount of rotation of the feed roller 1.

The embodiment also offers the following advantage.

Figure 11:
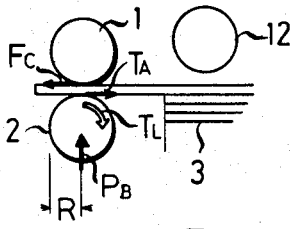
FIG. 11 is a view in explanation of the manner in which each sheet is conveyed.

FIG. 11 shows one sheet held between the feed roller 1 and separation roller 2. To enable the sheet to be fed properly in this case, the relation $F_C > T_A$ should hold where $F_C$ is the force with which the feed roller 1 feeds the sheet and $T_A$ is the force with which the sheet is returned by the separation roller 2. Here, $F_C = \mu_R \cdot P_B$ where $\mu_R$ is the coefficient of friction between the roller 1 and sheet, so that the following relation is obtained:

$$\mu_R \cdot P_B > T_A$$

$$\therefore P_B > T_A/\mu_R \quad (1)$$

The relation between the returning force $T_A$ exerted by the separation roller 2 and the torque $T_L$ of the torque limiter 16 can be expressed as follows:

$$T_A = T_L/R$$

where R is the radius of the roller 2. As can be seen in equation (1), in the graph shown in FIG. 13, a zone D below a straight line $P_B = T_A/\mu_R$ [hereinafter straight line (1)] is one in which it is impossible to properly feed a single sheet.

Figure 12:
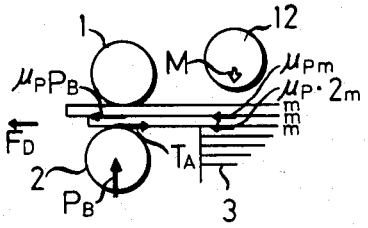
FIG. 12 is a view in explanation of the manner in which sheets are separated from each other.

When two sheets are to be fed, the relation $T_A > F_D$ should hold in FIG. 12, and $F_D = \mu_P(P_B + 3m)$ where $\mu_P$ is the coefficient of friction between the sheets and m is the weight of one sheet. Thus, the following equation is obtained:

$$T_A > \mu_P(P_B + 3m)$$

$$\therefore P_B < T_A/\mu_P - 3m \quad (2)$$

As can be seen in equation (2), in the graph shown in FIG. 13, a zone E above a straight line $P_B = \mu_P - 3m$ [hereinafter straight line (ii)] is one in which it is impossible to return the second sheet or to properly effect separation of the second sheet from the first sheet.

Figure 13:
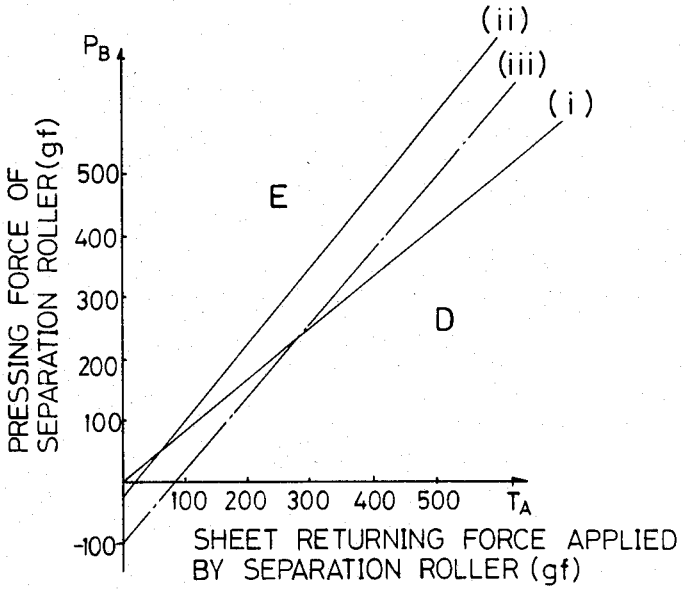
FIG. 13 is a diagrammatic representation of the range of sheet feeding conditions.

It will be seen, therefore, that if the values of $P_B$, B and $T_A$ are selected in a zone defined by the straight lines (i) and (ii) in FIG. 13, it is possible to achieve separation of the sheets moved into the nip between the feed roller and separation roller at all times.

Assume that the pickup roller 12 is kept in contact with sheets at all times. In this case, it would be necessary to take into consideration the resistance offered to the weight of the roller 12 in equation (2). As a result, the following relation is obtained:

$$P_B \cdot T_A/\mu_P - 3m - 2M \quad (3)$$

where M is the weight of the pickup roller 12. If equation (3) is taken into the graph shown in FIG. 13 by assuming that M=40, a zone above a straight line $P_B = T_A/\mu_P - 3m - 2M$ [hereinafter straight line (iii)] is one in which it is impossible to return the second sheet.

As can be seen in the figure, a zone defined between the straight lines (i) and (ii) is greater in area than a zone defined between the straight lines (i) and (iii). That is, in the embodiment, after the sheet is moved to the feed roller 1 and separation roller 2 by the action of the pickup roller 12, it is possible to set sheet feeding conditions including the pressing force $P_B$ exerted on the separation roller 2 at a wider range by letting the pickup roller 12 retire.

Figure 14:
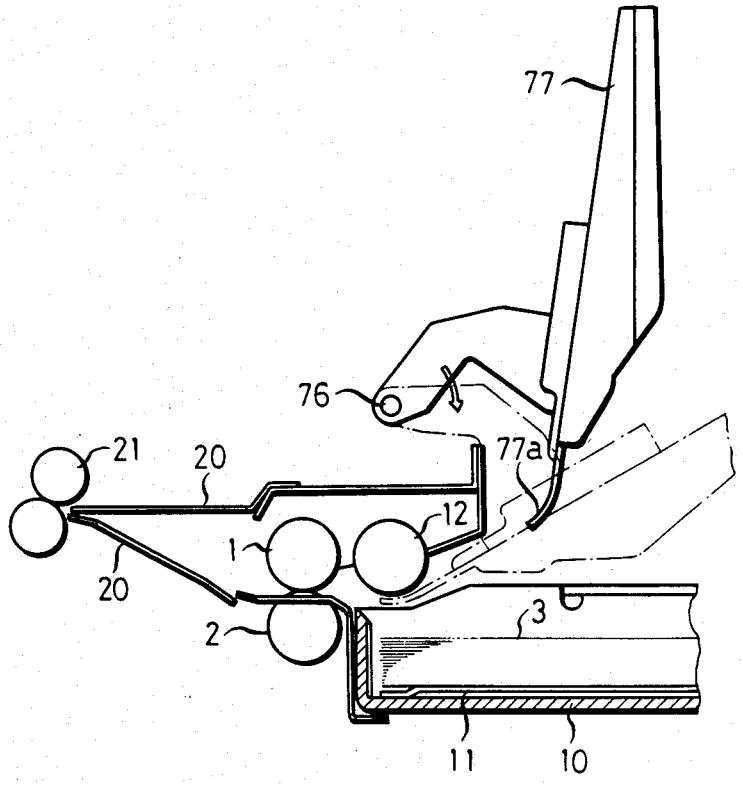
FIG. 14 is a schematic view in explanation of the manner in which a sheet is manually fed.

When in a normal condition, the pickup roller 12 is placed in the standby position. Thus, if it is desired to manually feed a sheet by using a manual feeding table 77 pivotally movable about a support pin 76 as shown in FIG. 14, it is possible to readily insert a forward end 77*a* of the manually inserting table 77 below the pickup roller 12 without the risk of damaging same. Moreover, when manual feeding of a sheet is performed, the pickup roller 12 is moved downwardly on the sheet after it is positively inserted, thereby aboiding an error in sheet feeding.

Means for driving the drive gear 13 described by referring to FIG. 3 will be described in detail.

Figure 15:
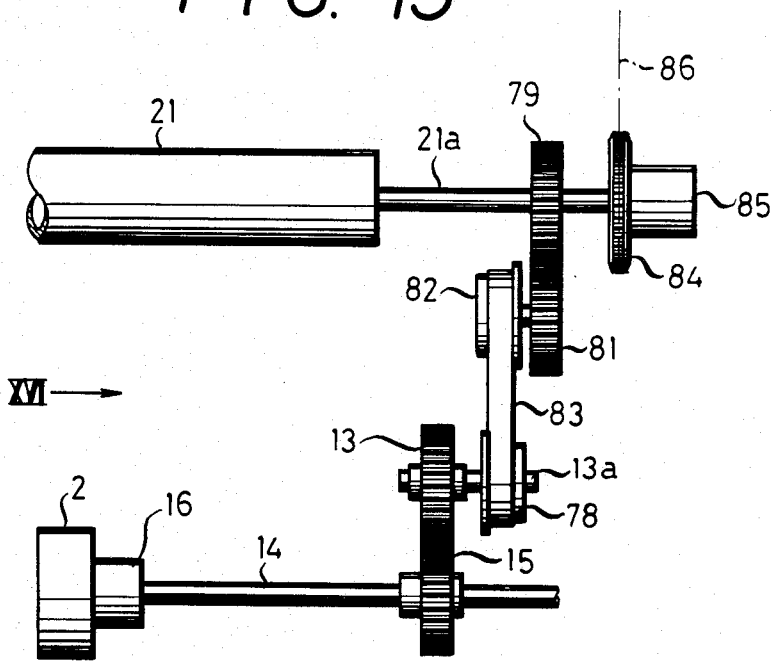
FIG. 15 is a schematic view of the drive system for the register rollers and separation roller.
Figure 16:
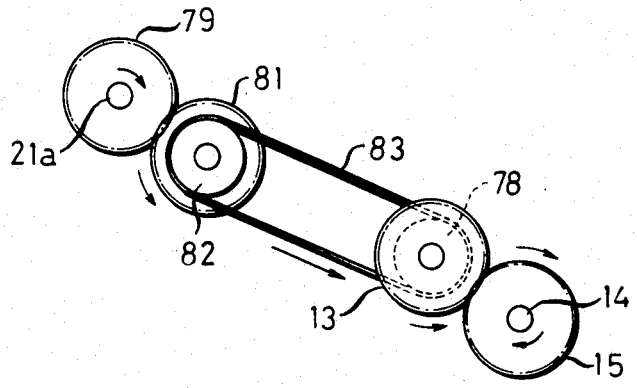
FIG. 16 is a sectional side view as seen in the direction of an arrow XVI in FIG. 15.

Referring to FIG. 15, the drive gear 13 is supported on a shaft 13*a* on which a pulley 78 is also supported. The register roller 21 is supported on a shaft 21*a* which supports a gear 79 in a suitable position. A timing belt 83 is trained over a pulley 82 supported on a shaft supporting a gear 81 meshing with the gear 79 and the pulley 78 supported on the shaft 13*a* of the drive gear 13. By this arrangement, the separation roller shaft 14 rotates whenever the register roller 21 rotates. The register roller shaft 21*a* and the separation shaft 14 both rotates in a clockwise direction in FIG. 16 which is a view as seen in the direction of the arrow XVI in FIG. 15.

In FIG. 15, secured to an end portion of the register roller shaft 21*a* are a sprocket wheel 84 and a clutch 85 of which the sprocket wheel 84 receives a movement is transmitted through a chain 86. The clutch 85 is in an ON position when the transfer-printing sheet 3 is delivered from the cassette 10 in FIG. 2, so that the separation roller shaft 14 rotates in a clockwise direction in FIG. 2 to apply a predetermined torque to the separation roller 2. The separation roller 2 performs separation of one transfer-printing sheet from other sheets, to thereby deliver only one sheet in a downstream direction.

The transfer-printing sheet 3*a* delivered in this way moves between the sheet guides 20 to the pair of register rollers 21. The transfer-printing sheet 3*a* is sensed by a photosensor 87 immediately before reaching the register rollers 21, and a sheet sensing signal is produced by the photosensor 87 to move the clutch 85 shown in FIG. 15 to an OFF position. This brings the register rollers 21 and the separation shaft 14 to a halt. The transfer-printing sheet 3*a* abutting against the register rollers 21 is given with a predetermined loosening as shown in FIG. 2 to have a skew removed, and then moved forwardly by the register rollers 21 which starts rotating in timed relation to rotation of a photosensitive member, not shown.

In the sheet feeding system according to the invention, since the register rollers 21 and the separation shaft 14 are drivingly connected to each other as aforesaid, the separation shaft 14 remains stationary while the register rollers 21 remain stationary or the transfer-printing sheet 3*a* remains stationary between the register rollers 21 and the separation roller 2. Thus, the separation roller 2 rotates in conjunction with the movement of the transfer-printing sheet 3*a*.

Assume that the separation roller 2 tries to continue its sheet separation operation or to rotate in a direction opposite the sheet feeding direction at a predetermined torque in spite of the transfer-printing sheet 3*a* being immobile. Then, the transfer-printing sheet 3*a* which is stationary would be pulled back, and the register rollers 21 might commit the error of not being able to move the sheet forwardly, thereby causing a disorderly sheet supply to occur. However, this phenomenon is avoided in the present invention because the separation roller shaft 14 remains stationary so long as the transfer-printing sheet 3*a* remains immobile.

In the description referring to FIG. 3, the torque limiter 16 has been shown as comprising the right portion 2*a* of separation roller 2, the torque limiter spring 18 and the separation hub 19. The invention is not limited to this specific construction of the torque limiter 16 and many changes and modifications may be made in the construction of torque limiter 16. One of them is shown in FIG. 17.

Figure 17:
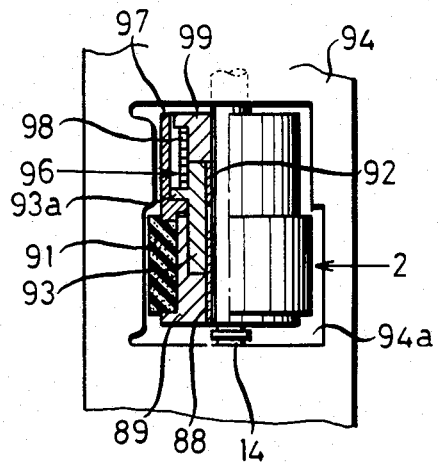
FIG. 17 is a sectional plan view of modification of the torque limiter.

Referring to FIG. 17 which is a view of the separation roller 2 as seen from the direction of the feed roller 1 in FIG. 2, the separation roller 2 comprises a metallic core 89 rotatably journalled by a slide bearing 88 secured to the separation shaft 14, and a rubber layer 91 located on an outer circumferential surface of the metallic core 89. Mounted on the shaft 14 is a torque limiter 96 adjacent the separation roller 2 which comprises a drive hub 99 secured to the shaft 14, a follower hub 93 rotatably journalled by a slide bearing 92 secured to the shaft 14, and a coil spring 98 mounted on the drive hub 99 and follower hub 93 with a predetermined biasing force to cause the follow hub 93 to clamp against the drive hub 99. About one half portion of a portion of the follower hub 93 on a side thereof opposite the drive hub 93 is in alignment with the metallic core 89 of the separation roller 2 and rotates therewith as a unit. Rotation of the separation roller shaft 14 is transmitted to the separation roller 2 by an amount corresponding to the predetermined torque by the biasing force causing the follower hub 93 against the drive hub 99, as described hereinabove.

Figure 18:
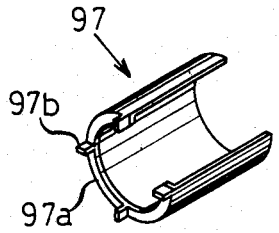
FIG. 18 is a perspective view of the torque limiter cover shown in FIG. 17.

The construction described hereinabove effectively transfers a torque to the roller 2. In the present invention, the torque limiter 96 is provided with a torque limiter cover 97 for enclosing an outer peripheral protion of the torque limiter 96 in spaced-apart relation. As shown in FIG. 18, the torque limiter cover 97 is cylindrical in shape and formed at one end thereof with an inwardly extending flange 97*a* formed with a plurality of projections 97*b* on an outer surface thereof. The flange 97*a* of the torque limiter cover 97 is forced against the separation roller 2 by a flange 93*a* formed on an outer peripheral surface of the follower hub 93 and the projections 97*b* thereof are fitted in recesses formed at an end face of the rubber layer 91 of the separation roller 2 in positions corresponding to the projections 97*b*, to thereby secure the torque limiter cover 97 in position with the flange surface being kept in pressing contact with the end face of the rubber layer 91 of the separation roller 2 without any gap therebetween.

The separation roller 2 and the torque limiter 96 enclosed by the cover 97 are exposed to view as shown in FIG. 17 without coming into contact with an edge of a cutout 94*a* formed in a sheet guide plate 94, and an upper portion of the separation roller 2 extends slightly upwardly from a top surface of the sheet guide plate 94 in coming into pressing contact with the feed roller 1. Thus an upper end of an external surface of the torque limiter cover 97 is substantially flush with the top surface of the sheet guide plate 94.

The sheet feeding system according to the invention is constructed as aforesaid, so that the end face of the rubber layer 91 of the separation roller 2 is in intimate contact with the torque limiter cover 97 without any gap therebetween, thereby avoiding the risk that paper dust might enter the torque limiter and interfere with its operation of transmitting a predetermined torque. Since the torque limiter cover 97 is spaced apart from the sheet guide plate 94 and the drive side of the torque limiter 96, it is capable of rotation with the separation roller 2 as a unit without any trouble. The provision of the cover 97 needs no additional space. In addition, the arrangement whereby the upper end of the external surface of the torque limiter cover 97 is substantially flush with the top surface of the sheet guide plate 94 and enables a sheet which is undulated to be positively guided.

What is claimed is:

1. A sheet feeding system of the frictional sheet separation roller type comprising:

(a) a feed roller rotatable about its axis to feed a sheet in a sheet feeding direction;

(b) a separation roller opposing said feed roller and rotatable opposite to the sheet feeding direction;

(c) a separation roller shaft supporting said separation roller at one free end thereof and pivotably supported at its other end in a pivot;

(d) biasing means for exerting a first pressing force on said shaft between said separation roller and said pivot to press said separation roller against said feed roller, and guiding means for guiding said shaft under said pressing force to be pivotable toward said feed roller in a plane including its own axis and the axis of said feed roller;

(e) a driven gear mounted on said separation roller shaft between said pivot and said separation roller, and a drive gear in mesh therewith for rotating said separation roller shaft in the direction opposite to the sheet feeding direction, said driven gear by engagement with said drive gear applying a second pressing force by a torque on said separation roller shaft; and (f) a torque limiter mounted on said separation roller shaft between said driven gear and said separation roller, said torque limiter having the torque on said separation roller shaft applied thereto and transmitting a selected torque to said separation roller to provide a sheet returning force, whereby a pressing force of said separation roller against said feed roller can be determined by the relation of the positions of the driven gear, biasing means, and separation roller from said pivot, and by said first and second pressing forces, and said sheet returning force is provided by the torque transmitted by said torque limiter from said second pressing force.

2. A sheet feeding system as claimed in claim 1, wherein said separation roller shaft supports thereon a torque limiter for applying the predetermined torque to the separation roller, said torque limiter forming a unitary structure with the separation roller shaft.

3. A sheet feeding system as claimed in claim 2, wherein said torque limiter is spaced apart from the separation roller by a gap, said unitary structure further comprising a torque limiter cover covering the gap and having an end face flush with the separation roller, said cover being rotatable with the separation roller as a unit, so as to prevent dust from entering the gap and impeding the operation of said torque limiter.

4. A sheet feeding system as claimed in claim 2, wherein an upper end of an external surface of said torque limiter cover is substantially flush with a top surface of a sheet guide plate surrounding the separation roller and the torque limiter.

5. A sheet feeding system as claimed in claim 1, further comprising a pickup roller brought into contact with a stack of sheets and rotating to pick up an uppermost sheet from the stack of sheets and move same to the feed roller, said pickup roller retiring to a position in which it is out of contact with the sheets when it does not move a sheet.

6. A sheet feeding system as claimed in claim 5, wherein said pickup roller is supported by an arm member pivotable about a drive shaft for driving the feed roller, and said arm member is pivotally moved by a cam secured to the drive shaft to thereby move the pickup roller to the retired position in which it is out of contact with the sheets.

7. A sheet feeding system as claimed in claim 1, further comprising a pickup roller brought into contact with a stack of sheets and rotating to pick up an uppermost sheet from the stack of sheets and move same to the feed roller, and a pair of register rollers for conveying the sheet fed by the feed roller after temporarily stopping same, wherein no torque is applied to the separation roller while the sheet remains stationary after being stopped by the register rollers.

8. A sheet feeding system as claimed in claim 1, wherein said gear is in mesh with said driven gear between said other end of the shaft and the separation roller, for rotating the separation roller shaft in said opposite direction, said drive gear being arranged to exert a pressing force opposite to the force of said pressing engagement of the separation roller with the feed roller, and said biasing means being located at a position between the gear and the driven separation roller.

9. A sheet feeding system as claimed in claim 1, wherein said guiding means comprises a guide surface aligned with said plane of the axes of the separation and feed rollers and said shaft having a bearing thereon in movable contact with said guide surface, and said biasing means comprising a spring biased lever having a lever end in pressing engagement with said bearing.

* * * * *